US006959690B1

(12) United States Patent
Reynard

(10) Patent No.: US 6,959,690 B1
(45) Date of Patent: Nov. 1, 2005

(54) FOUR QUARTER BUTTERFLY VALVE SYSTEM

(76) Inventor: Harlie David Reynard, 509 Johns Pass Rd., Madeira Beach, FL (US) 33708

( * ) Notice: Subject to any disclaimer, the term of this patent is extended or adjusted under 35 U.S.C. 154(b) by 32 days.

(21) Appl. No.: 10/928,064

(22) Filed: Aug. 27, 2004

(51) Int. Cl.[7] ..... F02D 9/08
(52) U.S. Cl. ..... 123/337; 123/336; 251/212; 251/305
(58) Field of Search ..... 123/337, 336, 123/319; 251/212, 305

(56) References Cited

U.S. PATENT DOCUMENTS 3,070,345 A * 12/1962 Knecht ..... 251/212
3,787,022 A * 1/1974 Wilcox ..... 251/212
3,799,502 A * 3/1974 Baum ..... 251/124
4,633,833 A * 1/1987 Morris ..... 123/336

* cited by examiner

*Primary Examiner*—Bibhu Mohanty
(74) *Attorney, Agent, or Firm*—Edward P. Dutkiewicz

(57) ABSTRACT

A butterfly valve system has an air cylinder with an internal passageway with an axis. An air control assembly includes a plurality of similarly configured plates positioned within the passageway with shafts mounted for independent oscillation and supporting the plates. A rocker arm is secured to each shaft to oscillate the rocker arms and shafts and plates independently of each other whereby the flow of air may be selectively controlled to generate a vortex flow by a user manipulating the drivers to open and close four quarter quadrants of the cross section of the cylindrical passageway.

11 Claims, 5 Drawing Sheets

FIG 5
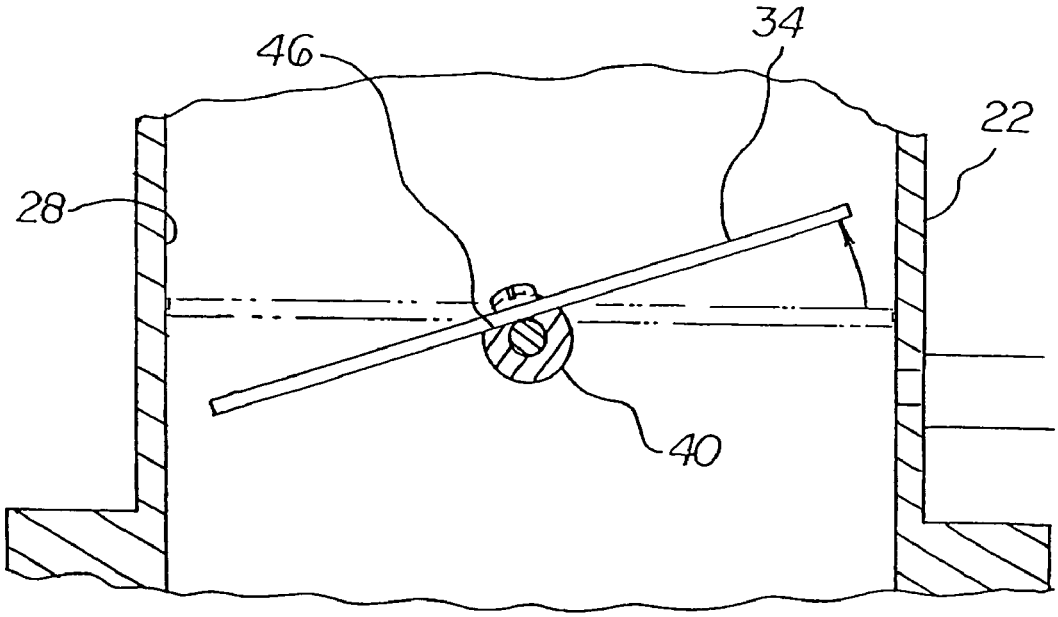
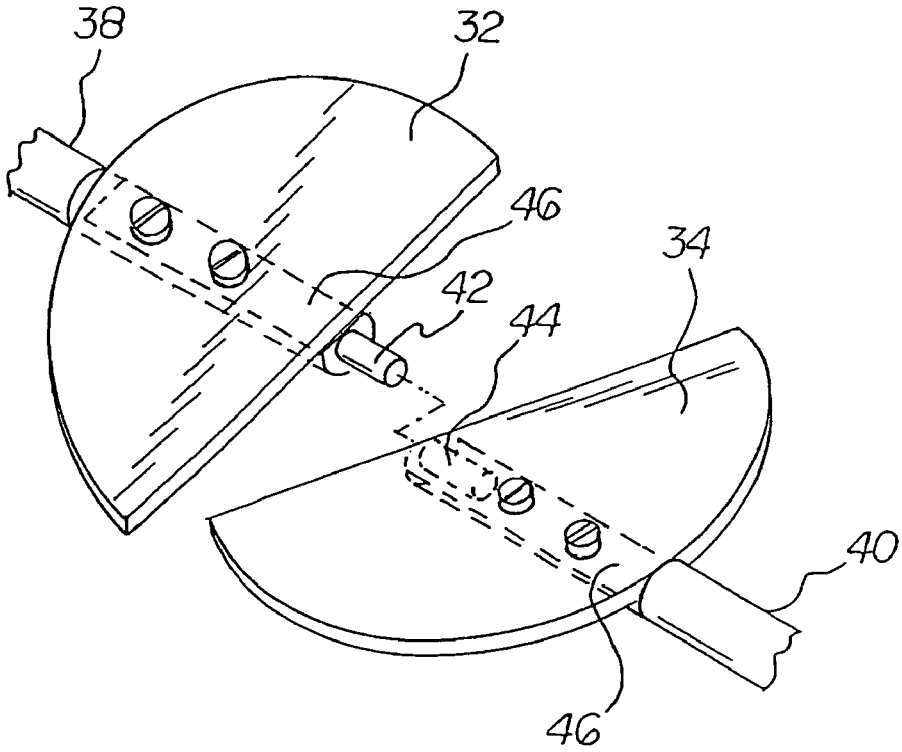
FIG 6

FIG 7
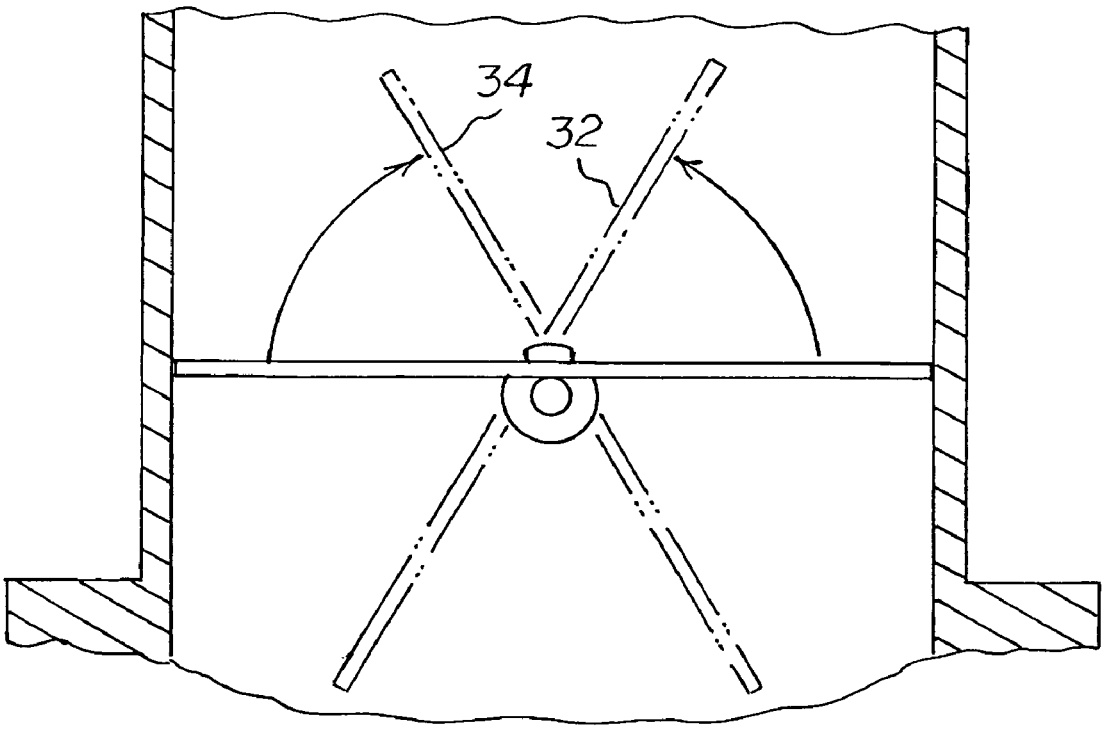
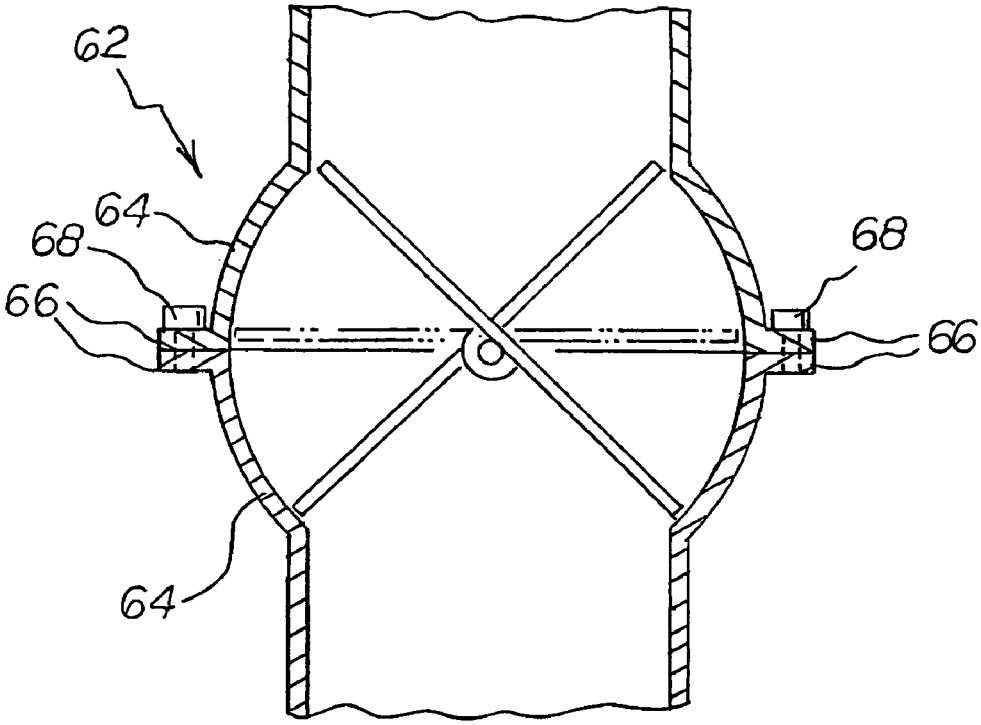
FIG 8

FOUR QUARTER BUTTERFLY VALVE SYSTEM

BACKGROUND OF THE INVENTION

1. Field of the Invention

The present invention relates to a four quarter butterfly valve system and more particularly pertains to controlling the passage of air through a cylindrical air passageway, whether a carburetor, a fuel injection system, air intake or exhaust assembly, to a hydrogen engine or any equivalent thereof, to achieve a vortex flow to increase the efficiency of an internal combustion engine.

2. Description of the Prior Art

The use of butterfly valve systems of known designs and configurations is known in the prior art. More specifically, butterfly valve systems of known designs and configurations previously devised and utilized for the purpose of controlling the passage of air through a cylindrical air passageway are known to consist basically of familiar, expected, and obvious structural configurations, notwithstanding the myriad of designs encompassed by the crowded prior art which has been developed for the fulfillment of countless objectives and requirements of the various embodiments of the present invention.

By way of example, U.S. Pat. No. 4,270,508 issued Jun. 2, 1981 to Lindberg relates to a combustion control system. U.S. Pat. No. 4,633,833 issued Jan. 6, 1987 to Morris relates to throttles with high velocity airstream collision. U.S. Pat. No. 6,305,835 issued Oct. 23, 2001 to Farrar relates to apparatus for handling and preparing fluids. Lastly, U.S. Pat. No. 6,330,825 issued Dec. 18, 2001 to Harness relates to an internal combustion engine fuel management system.

While these devices fulfill their respective, particular objectives and requirements, the aforementioned patents do not describe a four quarter butterfly valve system that allows controlling the passage of air through a cylindrical or spherical air passageway to achieve a vortex flow to increase the efficiency of an internal combustion engine.

In this respect, the four quarter butterfly valve system according to the present invention substantially departs from the conventional concepts and designs of the prior art, and in doing so provides an apparatus primarily developed for the purpose of controlling the passage of air through a cylindrical air passageway to achieve a vortex flow to increase the efficiency of an internal combustion engine.

Therefore, it can be appreciated that there exists a continuing need for a new and improved four quarter butterfly valve system which can be used for controlling the passage of air through a cylindrical air passageway to achieve a vortex flow to increase the efficiency of an internal combustion engine. In this regard, the present invention substantially fulfills this need.

SUMMARY OF THE INVENTION

In view of the foregoing disadvantages inherent in the known types of butterfly valve systems of known designs and configurations now present in the prior art, the present invention provides an improved four quarter butterfly valve system. As such, the general purpose of the present invention, which will be described subsequently in greater detail, is to provide a new and improved four quarter butterfly valve system and method which has all the advantages of the prior art and none of the disadvantages.

To attain this, the present invention essentially comprises an internal combustion engine. The engine has an extent formed with a circular opening there through for the passage of ambient air to be combusted in the internal combustion engine. The circular opening has a vertical axis.

Next provided is an air cylinder. The air cylinder has an upper end in communication with ambient air to be received and then passed to the internal combustion engine. The air cylinder also has a lower end formed with a flange coupled to the upper extent of the internal combustion engine. The air cylinder also has an internal cylindrical passageway aligned with the circular opening of the internal combustion engine. The cylindrical passageway has a vertical axis coaxial with the vertical axis of the circular opening.

An air control assembly is next provided. The air control assembly includes a pair of similarly configured semicircular plates positioned within the cylindrical passageway of the air cylinder. The control assembly also includes a pair of axially aligned bearing apertures with a horizontal axis formed in the air cylinder at a central elevation thereof with a first shaft and a second shaft each rotatably received in one of the apertures for independent oscillation. The first shaft and the second shaft each have interior ends in the cylindrical passageway of the air cylinder. A projection on the interior end of the first shaft mates with a recess on the interior end of the second shaft. The first shaft and second shaft each have flat axial sections receiving and supporting the plates and allowing for oscillation of the shafts and plates with respect to each other about the horizontal axis coextensive with the axis of the bearing apertures and perpendicular to the vertical axis of the cylindrical passageway of the air cylinder. The first and second shafts also have exterior ends located outside of the air cylinder on opposite sides thereof.

Next provided is a pair of fuel introduction openings with each fuel introduction openings containing a line for the introduction of fuel into the air cylinder at an elevation between the axis of rotation of the plates and the flange of the air cylinder.

Lastly, a rocker arm is provided. The rocker arm is secured to the exterior end of each shaft. A driver is secured to each rocker arm to oscillate the rocker arms and shafts and plates independently of each other. In this manner the flow of air may be selectively controlled to generate a vortex flow by a user manipulating the drivers to open and close four quarter quadrants of the cross section of the cylindrical passageway of the air cylinder.

In alternate embodiments of the invention, the passageway may be generally spherical in shape rather than cylindrical. The passageway may be positioned alone at an input area or alone at an exhaust area or together in series with passageways at both the input and exhaust areas. Further, the fuel introduction openings may be at any desired angular orientation with respect to the flow of air as a function of the particular system. Lastly, the four plates may be formed in a quarter-circular configuration with each plate being supported and controlled by it own shaft for independent oscillation of the four plates with respect to each other.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved four quarter butterfly valve system which has all of the advantages of the prior art butterfly valve systems of known designs and configurations and none of the disadvantages.

It is another object of the present invention to provide a new and improved four quarter butterfly valve system which may be easily and efficiently manufactured and marketed.

It is further object of the present invention to provide a new and improved four quarter butterfly valve system which is of durable and reliable constructions.

An even further object of the present invention is to provide a new and improved four quarter butterfly valve system which is susceptible of a low cost of manufacture with regard to both materials and labor, and which accordingly is then susceptible of low prices of sale to the consuming public, thereby making such four quarter butterfly valve system economically available to the buying public.

Even still another object of the present invention is to provide a four quarter butterfly valve system for controlling the passage of air through a cylindrical air passageway to achieve a vortex flow to increase the efficiency of an internal combustion engine.

Lastly, it is an object of the present invention to provide a new and improved butterfly valve system having an air cylinder with an internal passageway with an axis, an air control assembly including a plurality of similarly configured plates positioned within the passageway with shafts mounted for independent oscillation and supporting the plates, and a rocker arm secured to each shaft to oscillate the rocker arms and shafts and plates independently of each other whereby the flow of air may be selectively controlled to generate a vortex flow by a user manipulating the drivers to open and close four quarter quadrants of the cross section of the cylindrical passageway.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view of the system shown in the prior Figures taken along line 5—5 of FIG. 4.

FIG. 6 is an exploded perspective illustration of the plates and their supporting rods.

FIG. 7 is a cross sectional view similar to FIG. 5 but illustrating the plates in alternate orientations.

FIG. 8 is a cross sectional view of an alternate embodiment of the invention.

The same reference numerals refer to the same parts throughout the various Figures.

DESCRIPTION OF THE PREFERRED EMBODIMENT

Figure 1:
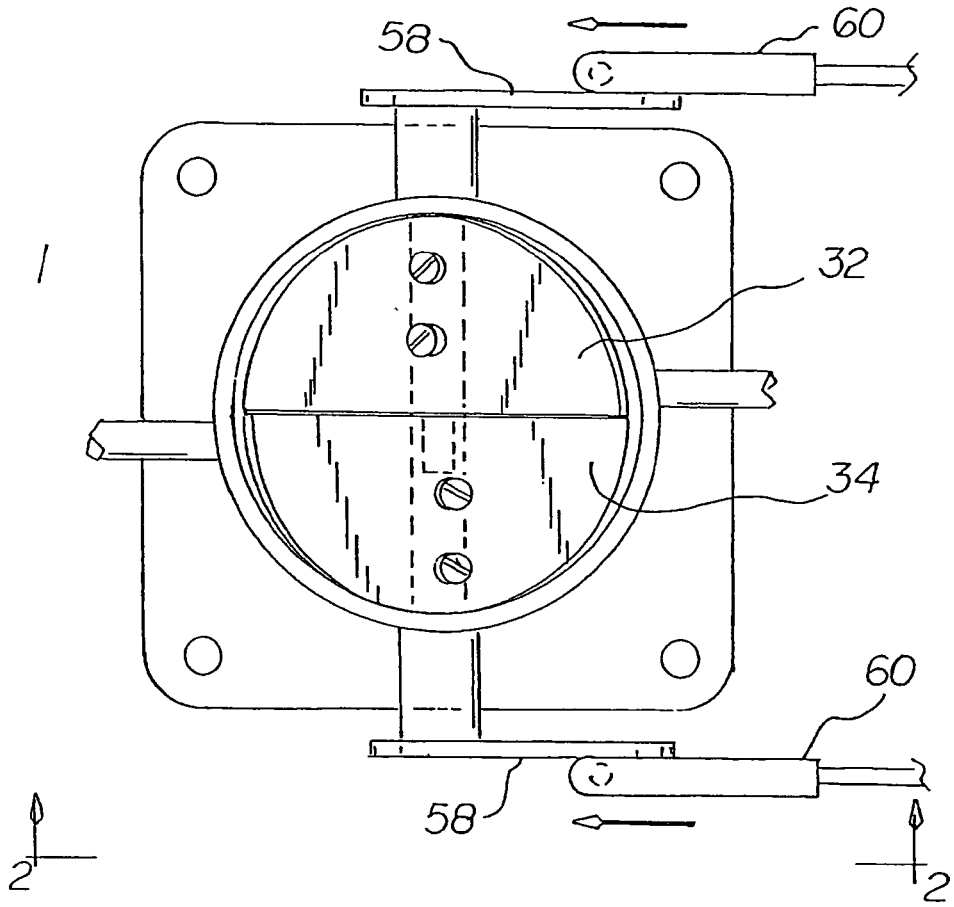
FIG. 1 is a plan view of a four quarter butterfly valve system constructed in accordance with the principles of the present invention.
Figure 2:
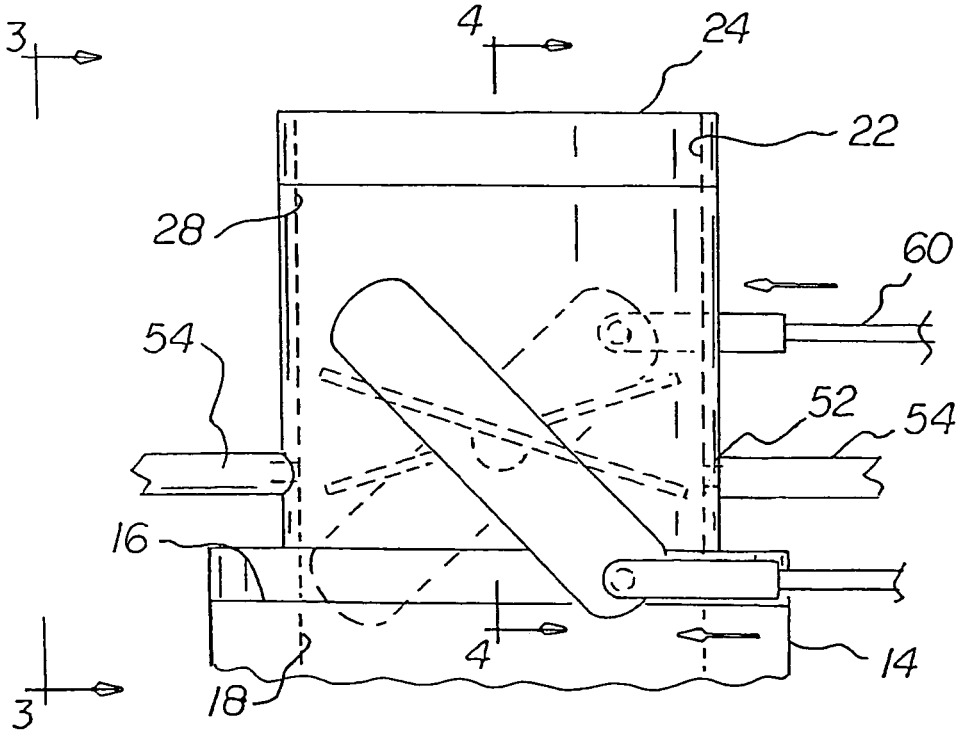
FIG. 2 is a side elevational view of the system shown in FIG. 1 taken along line 2—2 of FIG. 1.
Figure 3:
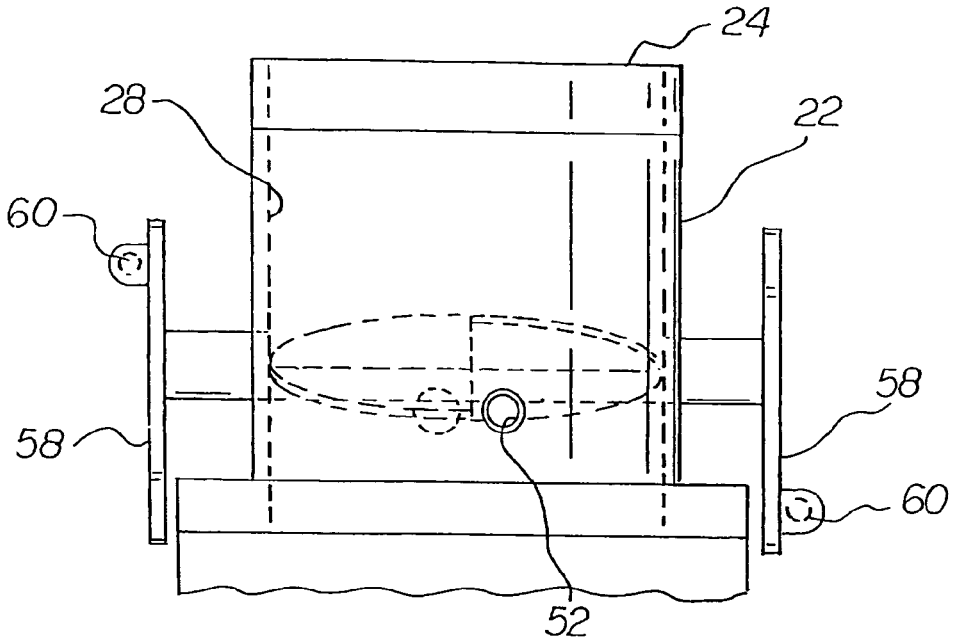
FIG. 3 is a front elevational view of the system shown in FIGS. 1 and 2 taken along line 3—3 of FIG. 2.
Figure 4:
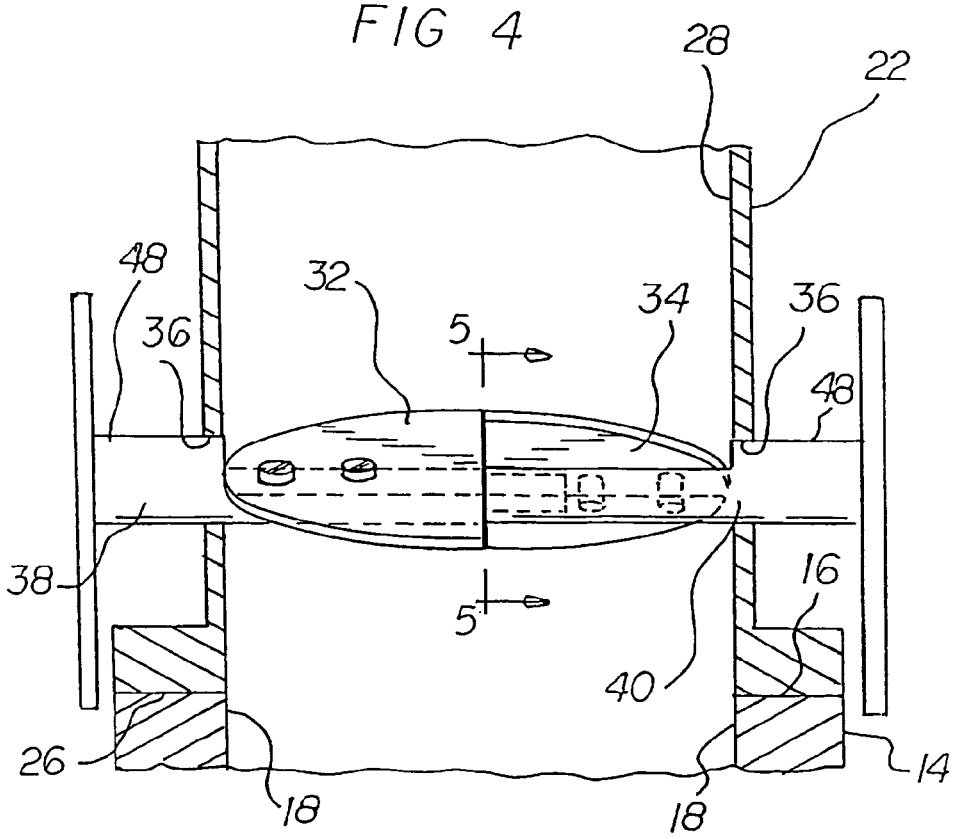
FIG. 4 is a cross sectional view of the system shown in the prior Figures taken along line 4—4 of FIG. 2.

With reference now to the drawings, and in particular to FIG. 1 thereof, the preferred embodiment of the new and improved four quarter butterfly valve system embodying the principles and concepts of the present invention and generally designated by the reference numeral 10 will be described.

The present invention, the four quarter butterfly valve system 10 is comprised of a plurality of components. Such components in their broadest context include an air cylinder, an air control assembly, at least one fuel introduction opening and a rocker arm. The system is operable as part of a carburetor, a fuel injection assembly, air intake to a hydrogen engine, an exhaust assembly or any equivalent thereof. Such components are individually configured and correlated with respect to each other so as to attain the desired objective.

First provided is an internal combustion engine 14. The engine has an upper extent 16 formed with a circular opening 18 there through for the passage of ambient air to be combusted in the internal combustion engine. The circular opening has a vertical axis.

Next provided is an air cylinder 22. The air cylinder has an upper end 24 in communication with ambient air to be received and then passed to the internal combustion engine. The air cylinder also has a lower end formed with a flange 26 coupled to the upper extent of the internal combustion engine. The air cylinder also has an internal cylindrical passageway 28 aligned with the circular opening of the internal combustion engine. The cylindrical passageway has a vertical axis coaxial with the vertical axis of the circular opening.

An air control assembly is next provided. The air control assembly includes a pair of similarly configured semicircular plates 32, 34 positioned within the cylindrical passageway of the air cylinder. The control assembly also includes a pair of axially aligned bearing apertures 36 with a horizontal axis formed in the air cylinder at a central elevation thereof with a first shaft 38 and a second shaft 40 each rotatably received in one of the apertures for independent oscillation. The first shaft and the second shaft each have interior ends in the cylindrical passageway of the air cylinder. A projection 42 on the interior end of the first shaft mates with a recess 42 on the interior end of the second shaft. The first shaft and second shaft each have flat axial sections 46 receiving and supporting the plates and allowing for oscillation of the shafts and plates with respect to each other about the horizontal axis coextensive with the axis of the bearing apertures and perpendicular to the vertical axis of the cylindrical passageway of the air cylinder. The first and second shafts also have exterior ends 48 located outside of the air cylinder on opposite sides thereof.

Next provided is a pair of fuel introduction openings 52 with each fuel introduction openings containing a line 54 for the introduction of fuel into the air cylinder at an elevation between the axis of rotation of the plates and the flange of the air cylinder.

Lastly, a rocker arm 58 is provided. The rocker arm is secured to the exterior end of each shaft. A driver 60 is secured to each rocker arm to oscillate the rocker arms and shafts and plates independently of each other. In this manner the flow of air may be selectively controlled to generate a vortex flow by a user manipulating the drivers to open and close four quarter quadrants of the cross section of the cylindrical passageway of the air cylinder.

In an alternate embodiment of the invention, the shaft is solid and the housing seamed along the pivot points. There may be more than two diverging valves, each independently pivoting to produce a vortex flow.

Figure 9:
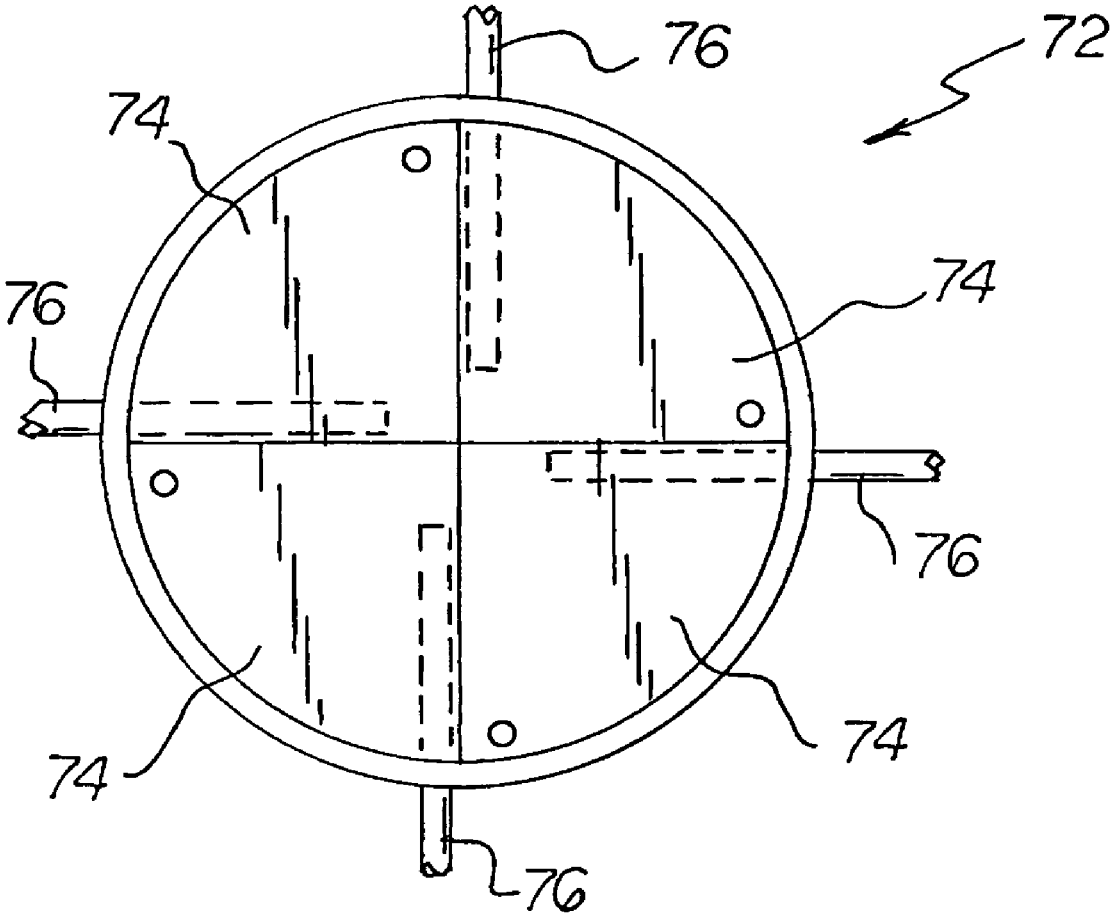
FIG. 9 is a plan view of another alternate embodiment of the invention.

Alternate embodiments of the invention are illustrated in FIGS. 8 and 9. In FIG. 8, the system 62 includes a passageway which is essentially spherical in configuration. The passageway if formed from two similarly configured hemispherical members 64 with mating flanges 66 and threaded fasteners 68. Such embodiment is shown without fuel inlet openings since the passageway is intended to be used at an exhaust area. It should be understood that the either the spherical passage way or the cylindrical passageway may be positioned alone at an input area or alone at an exhaust area or together in series with passageways at both the input and exhaust areas. Further, the fuel introduction openings may be at any desired angular orientation with respect to the flow of air as a function of the particular system.

Lastly, as illustrated in FIG. 9, an additional alternate embodiment of the invention is a system 72 utilizing four similarly configured plates 74. Each plate is in a quarter-circular configuration. Each plate is supported and controlled by it own shaft 76 for independent oscillation of the four plates with respect to each other. The four plate embodiment is readily adapted for use in either the cylindrical or spherical passageway. The four plate embodiment is also readily adapted for use at either the input area or the exhaust area.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A four quarter butterfly valve system for controlling the passage of air through a cylindrical air passageway to achieve a vortex flow to increase the efficiency of an internal combustion engine comprising, in combination:

an internal combustion engine with an upper extent formed with a circular opening there through for the passage of ambient air to be combusted in the internal combustion engine, the circular opening having a vertical axis;

an air cylinder having an upper end in communication with ambient air to be received and then passed to the internal combustion engine, the air cylinder having a lower end formed with a flange coupled to the upper extent of the internal combustion engine, the air cylinder also having an internal cylindrical passageway aligned with the circular opening of the internal combustion engine, the cylindrical passageway having a vertical axis coaxial with the vertical axis of the circular opening;

an air control assembly including a pair of similarly configured semicircular plates positioned within the cylindrical passageway of the air cylinder, the control assembly also including a pair of axially aligned bearing apertures with a horizontal axis formed in the air cylinder at a central elevation thereof with a first shaft and a second shaft each rotatably received in an aperture for independent oscillation, the first shaft having an interior end in the cylindrical passageway of the air cylinder with a mating projection and the second shaft having an interior end in the cylindrical passageway of the air cylinder with a mating recess, the first and second shafts having flat axial sections receiving and supporting the plates and for allowing oscillation of the first and second shafts and plates with respect to each other about the horizontal axis coextensive with the axis of the bearing apertures and perpendicular to the vertical axis of the cylindrical passageway of the air cylinder, the first and second shafts also having exterior ends located outside of the air cylinder on opposite sides thereof;

a pair of fuel introduction openings with each fuel introduction openings containing a line for the introduction of fuel into the air cylinder at an elevation between the axis of rotation of the plates and the flange of the air cylinder; and a rocker arm secured to the exterior end of each shaft with a driver secured to each rocker arm to oscillate the rocker arms and shafts and plates independently of each other whereby the flow of air may be selectively controlled to generate a vortex flow by a user manipulating the drivers to open and close four quarter quadrants of the cross section of the cylindrical passageway of the air cylinder.

2. A butterfly valve system for controlling the passage of air through a cylindrical air passageway to achieve a vortex flow comprising:

an air cylinder having an internal passageway with an axis there through;

an air control assembly including a plurality similarly configured plates positioned within the passageway with the plates being aligned along a diameter line of the opening of the cylinder, with each plate having a shaft coupled thereto, with the shaft being oriented perpendicular to the diameter line, thereby allowing each shaft to independently oscillate each plate and the shaft supporting each of the plates whereby the flow of air may be selectively controlled to generate a vortex flow by manipulating the shafts to open and close a portion of the cross section of the passageway.

3. The system as set forth in claim 2 and further including an internal combustion engine with an upper extent formed with a circular opening there through supporting the air cylinder.

4. The system as set forth in claim 2 and further including a driver secured to each shaft to oscillate the shaft.

5. The system as set forth in claim 2 wherein the passageway is cylindrical in shape.

6. The system as set forth in claim 2 wherein the passageway is generally spherical in shape.

7. The system as set forth in claim 2 wherein there are two semi-circular plates and two shafts.

8. The system as set forth in claim 2 wherein there are four quarter-circular plates and four shafts.

9. The system as set forth in claim 2 wherein the passageway is at an input area with at least one fuel input opening.

10. The system as set forth in claim 2 wherein the passageway is at an exhaust area.

11. The system as set forth in claim 2 wherein the passageway includes an input area in series with an exhaust area, the input area having at least one fuel input opening.

* * * * *